United States Patent [19]

Wessel et al.

[11] 4,104,342

[45] Aug. 1, 1978

[54] METHOD FOR MAKING METAL POWDER OF LOW OXYGEN CONTENT

[75] Inventors: Otto Wessel, Duisburg; Georg Hofmann, Krefeld; Hartmut Gesell; Werner Scholz, both of Duisburg, all of Fed. Rep. of Germany

[73] Assignee: Mannesmann Aktiengesellschaft, Dusseldorf, Fed. Rep. of Germany

[21] Appl. No.: 284,504

[22] Filed: Aug. 29, 1972

[30] Foreign Application Priority Data

Aug. 31, 1971 [DE] Fed. Rep. of Germany ..... 2144220

[51] Int. Cl.[2] ..... B01J 2/16

[52] U.S. Cl. ..... 264/12; 264/14; 264/37; 264/DIG. 51

[58] Field of Search ..... 264/14, 7, 37, 12, DIG. 51

[56] References Cited

U.S. PATENT DOCUMENTS

| | | | |
|---|---|---|---|
| 3,457,336 | 7/1969 | Harris | 264/14 |
| 3,655,837 | 4/1972 | Reed et al. | 264/14 |

*Primary Examiner*—Robert F. White
*Assistant Examiner*—James R. Hall
*Attorney, Agent, or Firm*—Ralf H. Siegemund

[57] ABSTRACT

A method for making metal powder by atomizing molten metal is improved by causing the solidifying metal droplets to be subjected to a whirling flow of a powdery coolant such as a different powder, e.g. quartz sand or powder separated from the extracted flow of powder just made and cooled additionally. The whirling flow is sustained by blowing an inert gas in up direction into the powder collection chamber.

13 Claims, 4 Drawing Figures

1
2
3
18
11
8
10
9
5
13
4
12
7
6
14
15
16
17

METHOD FOR MAKING METAL POWDER OF LOW OXYGEN CONTENT

BACKGROUND OF THE INVENTION

The present invention relates to a method of making metal powder with low oxygen content, wherein the method includes atomizing molten metal by means of a pressurized gas which does not cause oxygenization, or is neutral or has reducing properties, such as nitrogen, argon or the like. More particularly, the present invention relates to improvements in such methods wherein molten metal is fed to an atomizer nozzle, and the solidified metal droplets are collected in a container underneath and cooled; whereby feeding, atomization, collecting and cooling is carried out in an enclosure under exclusion of oxygen.

Production of low oxygen content metal powder has recently become of increasing interest, and efforts along that line have increased accordingly. Generally, these known methods provide for atomization of molten metal in an air-tight container by means of an inert gas. The molten metal pours into and through an annular nozzle arrangement, or along a nozzle or nozzles, with longitudinal slots through which pressurized gas is directed at high speed and acts against the stream of molten metal. As a consequence, the metal stream is broken up, i.e. atomized, and metal droplets are produced which are collected and cooled in a container underneath the nozzle arrangement.

A water bath should not be used for cooling low oxygen metal powder, because of the oxygen contained in water; thus, the inert gas provides also the function of cooling the powder particles. The atomized metal droplets require some period of time for solidifying and cooling and the solidification process must be completed as the formed droplets fall and fly to the bottom of the container so that the atomizing container must be relatively high.

It was found, however, that even in the case of long flying trajectories and large vessel heights, such as 10 meters, the particles are still quite hot and they still have the tendency of sticking together. In other words, the powder as collected in the bottom of the container is not sufficiently loose and powdery, but is readily amenable to cake.

It has been tried to cool the container, particularly the bottom, from the outside. However, such cooling is not sufficient as the still relatively loose pile of powder (at least adjacent the cooled bottom) has very low thermal conductivity and that impedes cooling of the interior and upper portions of the powder heap. Consequently, only small quantities of powder can be produced here in one run before emptying the container and starting anew.

The discharge of powder during production is difficult as oxygen may very likely enter the atomizing chamber, etc. Thus, discontinuous production wherein atomization and powder removal alternate at a high rate was heretofore deemed necessary.

DESCRIPTION OF THE INVENTION

It is an object of the present invention to provide a method of atomizing molten metal to produce loosely piling powder which is adequately cooled as it collects in the bottom of the atomizing chamber. It is another object of the present invention to provide a method of atomizing molten metal in which the metal droplets are cooled directly and the powder particles are continuously removed from the chamber container without admission of oxygen.

In accordance with the preferred embodiment of the invention, it is suggested to sustain a whirling flow in the atomizing chamber using a powdery solid material, which is capable of flowing as a powder (fluidization) and mixes with the falling droplets for cooling. Since solidification of the droplets is to be obtained as stated above, the powder used for cooling must have temperature below the melting point of the metal. The whirling flow is produced by blowing an inert gas into the collection chamber and which does not cause oxygenation of the metal, or is neutral, or has reducing properties. The powdery coolant may be the same or a different kind of powder as produced; in the latter case, the two powders are separated outside of the atomizing chamber; in the former case, a portion of the powder as produced is recirculated as coolant powder.

The whirl flow and cooling material may, for example, consist of a non-metallic powder such as quartz sand. Alternatively, a metal powder having some basically different properties as the powder to be produced is used. Thus, the two powders may differ as to magnetic properties; one being easily magnetizable, the other one not. Such a difference in properties is needed for obtaining subsequently complete separation of the powders, e.g. through a magnetic field, or through floatation or gas flow separation. Alternatively, previously atomized metal powder can be used as whirl flow cooling agent. Some of the powder which has just been made is separated, cooled and recycled into the whirl flow.

In order to practice the method of the invention, particular means are needed to produce the whirl or whirling flow. Accordingly, it is suggested to provide a fine mesh sieve or straining plate near the bottom of the atomizing container chamber. Inert gas is fed to the chamber underneath that plate, and the added coolant powder, as well as the powder just made, is sucked from the whirling flow above the sieve or straining plate. The gas is then separated from the powder mixture, and subsequently the two different powders, if such are used, are separated from each other. The coolant powder is recycled, the powder just made is stored. The separated gas may likewise be recycled so that there is a closed loop (admitting no oxygen) of the gas that produces the whirling flow. The recycled powder should be cooled before being returned as coolant to the enclosure through which the metal droplets fall pursuant to the atomization process. This is particularly necessary if powder particles just made are branched off to serve as coolant in the whirl flow chamber.

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 shows somewhat schematically an apparatus for cooling atomized, metal powder by means of whirl flow which includes quartz sand;

FIGS. 2 and 3 show two modifications of the apparatus shown in FIG. 1, particularly as far as withdrawal of the powder from the cooling chamber is concerned; and FIG. 4 shows an apparatus in which atomized metal powder is used as coolant.

DESCRIPTION OF THE DRAWINGS

Proceeding now to the detailed description of the drawings, reference numeral 1 denotes the atomizing equipment proper, wherein molten metal is atomized by means of an inert gas. Equipment of this type is known and, for example, disclosed in patent application Ser. No. 227,044, filed Feb. 12, 1972, of common assignee, now abandoned.

The bottom portion of equipment connects to a collection chamber of a vessel 2 and is otherwise airtightly sealed. Thus, reference numerals 1 and 2 denote an enclosure for the atomization which does not admit oxygen. The metal flows into the atomization chamber under exclusion of surrounding air, and the discharge from chamber 2 is likewise carried out so that oxygen is not admitted as will be described. Gas used for atomization may be discharged from the system 1 - 2 through outlet 3. After cleaning and recompression, that gas can be used again in equipment 1 as atomizing agent.

Figure 1:
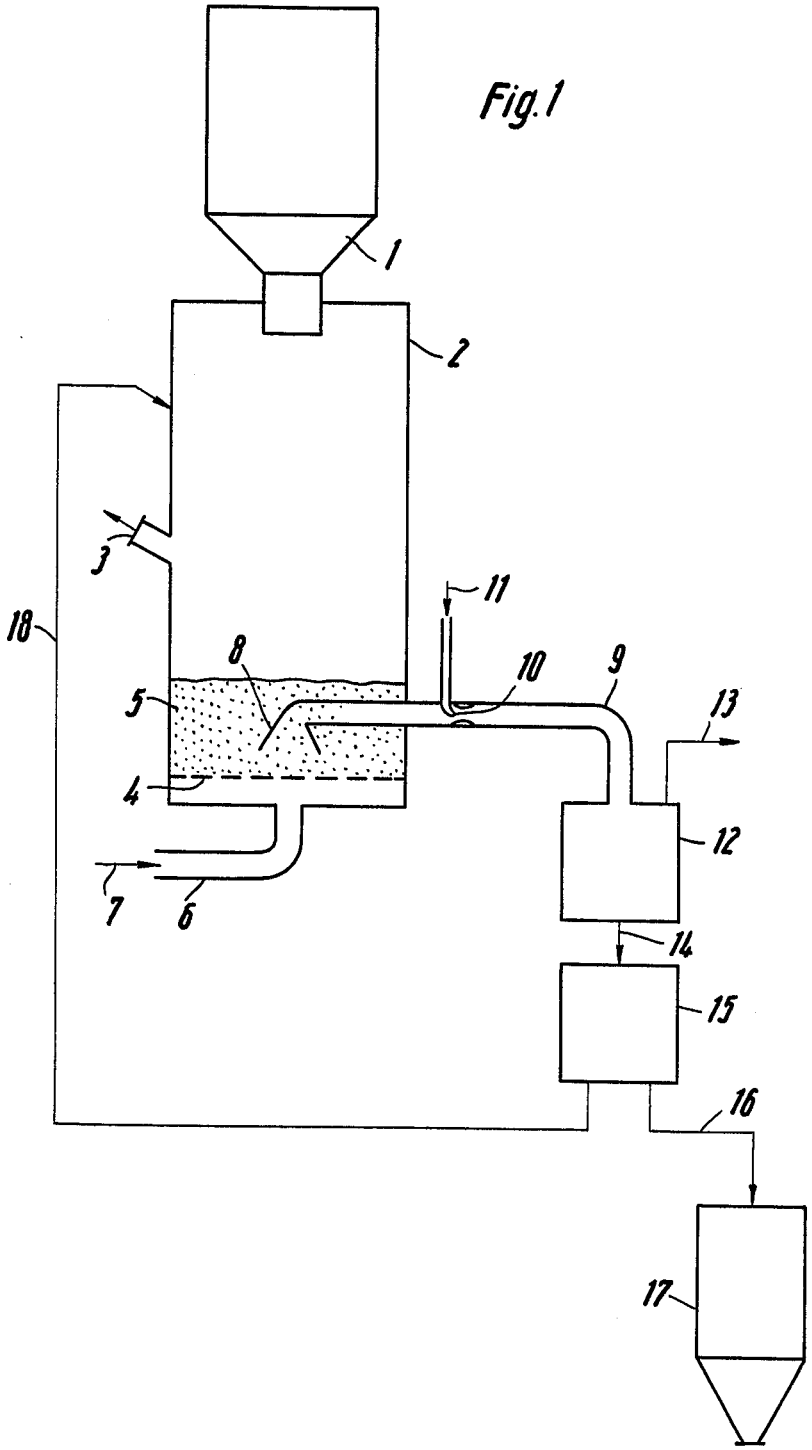

A sieve plate 4 is mounted in vessel 2 having very fine mesh so that metal powder does not fall through. A feeder line 6 for gas leads into vessel 2 underneath plate 4. Arrow 7 denotes pressurized gas flow through pipe 6 and into vessel 2 for producing a whirling flow therein. The gas of flow 7 is likewise a gas that reduces, does not cause oxidation or is neutral; it can be the same but does not have to be the same as the atomizing gas.

The process is started by placing quartz sand onto the plate 4, and as soon as gas enters the vessel 2 through pipe 6, the quartz sand is blown up, and a whirling flow of this coarse powder is maintained in vessel 2 forming a fluidized bed 5. As soon as the atomizing process begins, metal droplets begin to pour from equipment 1 into vessel 2 and fall in the fluidized bed of quartz sand. The metal droplets intercept the blown up quartz sand and are intimately mixed in the fluidized bed 5. A whirling flow of mixed metal and quartz particles is sustained by the pressurized gas flow which blows through the sieve plate 4 in upwardly direction. As the cooling quartz sand mixes intimately with the metal particles, the latters are cooled accordingly and solidified.

A discharge and suction opening 8 for a suction line 9, is disposed above plate 4 for sucking a gas-quartz sand-metal powder mixture from the chamber of vessel 2 at a particular rate. Suction is obtained by means of an injector 10 in suction line 9 and driven also by a flow of the inert gas through pipe 11. This way, oxygen will not enter vessel 2 (as long as the gas is kept sufficiently free from oxygen).

Separating equipment 12, e.g. a cyclone, separates inert gas from the powder. The gas is discharged at 13, filtered and/or otherwise cleaned and compressed and can then be used again as whirl flow driving gas in flow 7. The powder mixture discharges from separator 12 and feeds into a magnetically or floatationally operating separator 15 wherein the metal powder is separated from the quartz. The metal powder is moved via a line 16 to a storage vessel 17. The quartz sand is recirculated by means of a line 18 and enters vessel 2 in an upper region.

Figure 2:
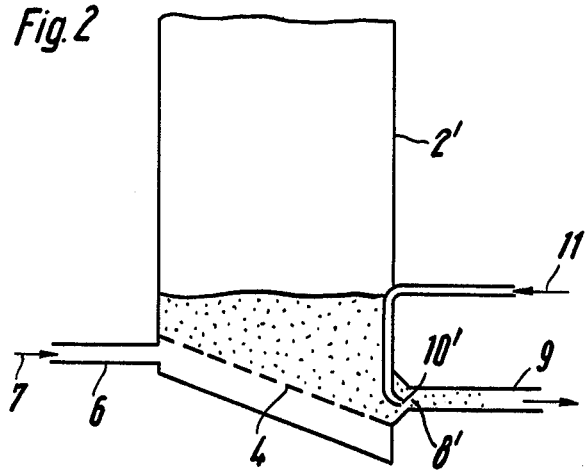

Turning now to FIG. 2, elements 1 and 12 through 18 are provided as before. The equipment illustrated differs from the one in FIG. 1 in the construction of the bottom portion of vessel 2'. The bottom is shown in slanted configuration, and the sieve plate 4 has inclined position accordingly. The gas flow 7 enters vessel 2' still underneath plate 4, but at the high point of the bottom, while ejection suction device 10' is disposed in the exit opening 8', still above sieve 4, but adjacent the low point of the bottom.

Figure 3:
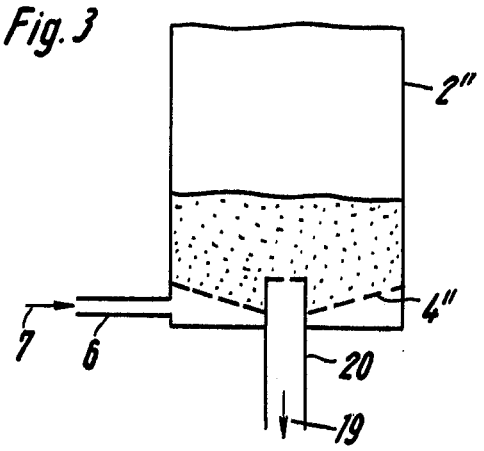
Figure 4:
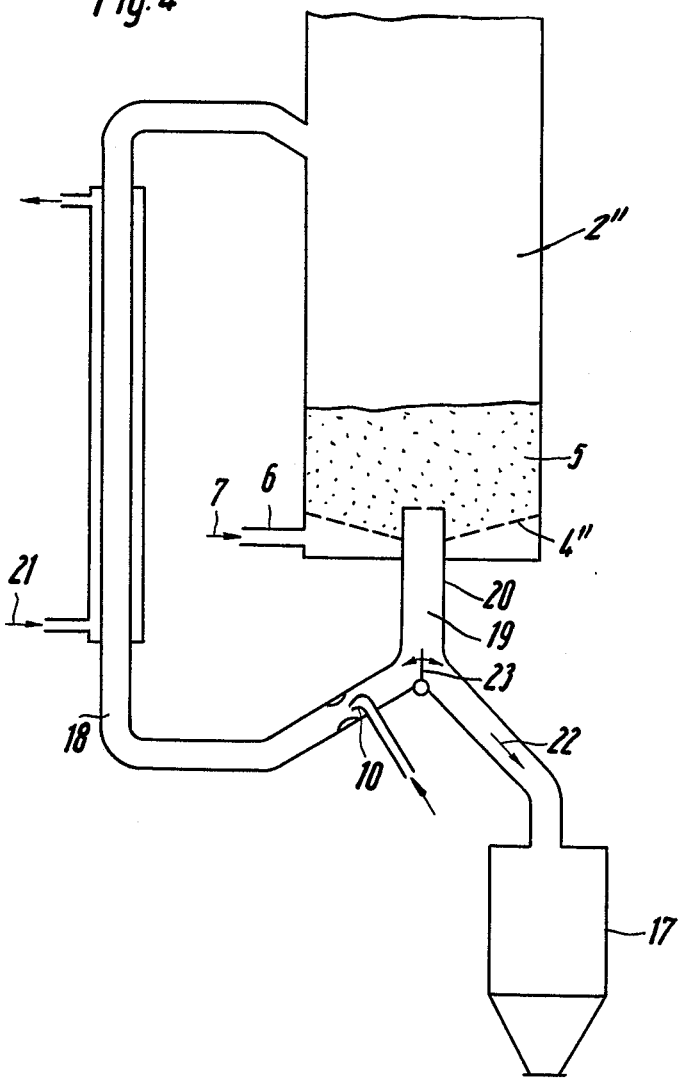

In the example of FIG. 3, powder is discharged from vessel 2'' by means of free fall (19). A pipe 20 with upper opening projects into the vessel through the bottom as well as through a funnel shaped sieve 4''. Powder will drop into the pipe 20 which then leads to the separators as before. Since some gas will be included in the flow 19, a separator such as 12 should also be included here. However, the gas of flow 7 may in this case be withdrawn, also through the gas outlet 3 as was shown in FIG. 1. The examples as described thus far use a different material as whirling flow and cooling powder and to be separated therefrom subsequently for separate recirculation. The example of FIG. 4 uses atomized metal itself as whirl flow powder. The vessel 2'' is constructed basically as shown in FIG. 3. However, pipe 20 branches into two separate flow paths, established by pipes 18 and 22. A divider flap 23 regulates the flow into the two branch lines. Some of the now cooled powder passes through pipe 22 to storage bin 17. A second portion runs through a pipe 18 and into an active cooler 21 from which this powder flow is charged into the vessel 2 to serve therein as whirl flow cooling agent. The ejector pump 10 provides driving power to run the powder through the cooler 21 and up for charging vessel 2'' from above.

It can thus be seen that the apparatus for carrying out the method in accordance with the present invention produces metal powder which contains no (or as little as possible) oxygen. The powder when produced is fast but gently cooled and removed from the atomizing equipment in continuous. As inert gas is blown into the equipment and sustains pressure therein, such gas will discharge whereever discharge outlets are provided and thus establishes a barrier against admission of oxygen. The invention is particularly suited for making steel alloy powder which can now readily be press worked as the particles have no oxide skin. Form parts pressed from such powder particles are very strong. The particular mode of cooling permits continuous operation of the atomizing process.

It should be pointed out, that the gas used for atomizing the molten metal and the gas used for sustaining the whirling flow can, but do not have to be, the same. However, when the system operates with recirculating gas flow, mixture of the two circulations is inevitable and for purposes of practicing the invention there is no need in principle to keep these circulations completely separate.

We claim:

1. In a method of producing metal powder by means of atomizing a stream of molten metal through a pressurized gas, wherein the resulting metal droplets upon solidifying fall as particles in a vessel towards the bottom of the vessel, in which the atomization takes place, the improvement comprising the steps of:

(a) providing a cooling powder to the vessel, the powder having temperature below the melting point of the metal;

(b) feeding a gas into the vessel near the bottom thereof and including blowing the gas in an upward direction for blowing the cooling powder also in an upward direction to form a fluidized bed, the falling metal particles as intercepting the upwardly blown cooling powder is intimately mixed with said cooling powder for obtaining a mixture of metal particles and cooling powder whirling together in the fluidized bed, wherein said metal particles are cooled and solidified by the cooling powder;

(c) extracting a portion of the mixture of solidified metal particles and cooling powder from the fluidized bed in the vessel by maintaining an extracting gas flow from the vessel carrying along metal particles and cooling powder as mixed together and out of the vessel.

2. In a method as in claim 1, and including the step of providing a continuous circulation of the cooling powder after the extraction step, through separation of the powder from the metal particles as extracted together and return of the powder to the vessel.

3. In a method as in claim 2, and including cooling the recirculated powder prior to returning the powder to the vessel.

4. In a method as in claim 1, wherein the cooling powder material is different from the metal and having properties permitting separation, the extraction step being followed by a step of separating the cooling powder from the metal particles.

5. In a method as in claim 4, wherein the separated cooling powder is returned to the vessel.

6. In a method as in claim 4, wherein the cooling powder used is non-metallic.

7. In a method as in claim 6, wherein the cooling powder used is quartz sand.

8. In a method as in claim 4, wherein the metal and the cooling powder used have different magnetic properties.

9. In a method as in claim 1, wherein the cooling powder is metal powder separated from the metal powder as made and fed to the vessel.

10. In a method as in claim 9, wherein the metal powder as extracted from the vessel and as separated as cooling powder, is separately cooled and fed to the vessel.

11. Method as in claim 1, and using a sieve plate near the bottom of the vessel, the sieve preventing metal particles from falling through, said step (b) including blowing the gas flow through the sieve from below, so that the whirling flow is sustained above the sieve, the extracting of the particles and of the powder being carried out from above the sieve.

12. Method as in claim 11, and including the step of separating gas from the extracted gas, powder and particles as mixed.

13. Method as in claim 12, and including the step of separating some of the extracted powder and feeding same to the vessel at a location above the extraction.

* * * * *